US009487989B2

(12) United States Patent
Nietzel et al.

(10) Patent No.: US 9,487,989 B2
(45) Date of Patent: Nov. 8, 2016

(54) DOOR COLLAR LOCK

(71) Applicants: Daniel Nietzel, Muscatine, IA (US); Jame Charles Hayes, Wilton, IA (US); Edwin Felix Colon, Muscatine, IA (US); John Harold Lawrence, Muscatine, IA (US); Michael Jon Morgan, Muscatine, IA (US)

(72) Inventors: Daniel Nietzel, Muscatine, IA (US); Jame Charles Hayes, Wilton, IA (US); Edwin Felix Colon, Muscatine, IA (US); John Harold Lawrence, Muscatine, IA (US); Michael Jon Morgan, Muscatine, IA (US)

( * ) Notice: Subject to any disclaimer, the term of this patent is extended or adjusted under 35 U.S.C. 154(b) by 67 days.

(21) Appl. No.: 14/244,091

(22) Filed: Apr. 3, 2014

(65) Prior Publication Data

US 2015/0284982 A1 Oct. 8, 2015

(51) Int. Cl.
*E05B 15/02* (2006.01)
*E05F 3/22* (2006.01)

(52) U.S. Cl.
CPC ..... *E05F 3/227* (2013.01); *E05Y 2201/10* (2013.01); *E05Y 2900/132* (2013.01); *Y10T 292/694* (2015.04)

(58) Field of Classification Search
CPC ..... E05Y 2201/224; E05C 17/54; E05C 19/182; E05C 17/025; Y10T 292/73; Y10T 16/61; Y10T 292/71; Y10T 292/34; Y10T 16/27; E05F 5/06; Y10S 292/15; E05D 11/06
USPC ..... 292/341.14
See application file for complete search history.

(56) References Cited

U.S. PATENT DOCUMENTS 4,648,152 A * 3/1987 Grewall ..... E05C 17/025 16/347
7,644,964 B2 * 1/2010 Bushey ..... E05C 17/54 16/82

* cited by examiner

*Primary Examiner* — Mark Williams
(74) *Attorney, Agent, or Firm* — Jacque R. Wilson; Carson Boxberger LLP

(57) ABSTRACT

An apparatus holds a door closed comprising: a top panel, a left wall and a right wall. A flap is attached to the left wall opposite the top panel and folded under the apparatus. A flap is attached to the right wall opposite the top panel and folded under the apparatus. The apparatus contains a front end, a back end and an opening at the front end that has a larger cross section than a cross section of the back end thereby providing for a tapered shape of the apparatus overall, such that the apparatus is configured to fit over two hinged arms of a door closing system, preventing the arms from articulating open to prevent the door from opening.

8 Claims, 6 Drawing Sheets

DOOR COLLAR LOCK

CROSS REFERENCE TO RELATED APPLICATIONS

This is a continuation-in-part of U.S. patent application Ser. No. 14/099,912 filed Dec. 7, 2013.

FIELD OF THE INVENTION

The present invention generally relates to a door collar lock. More specifically, the invention relates to a system and method for securing a door in a closed position using a door collar locking device.

BACKGROUND OF THE INVENTION

The use of door closing mechanisms having a rod and associated piston operating within a cylinder is well known. For instance, in residential applications, it is well known to connect such a mechanism between the door and its frame to act as a shock absorber or dampener against the action of a closing force such as a spring or a partial vacuum within the cylinder.

It has been known to provide different types of stops in conjunction with such closing mechanisms, which allow the door to be closed only partially, thereby temporarily maintaining the door in the desired position against the closing force. One of the more common types of prior art devices consists of a stop washer mounted on the piston rod. The washer is wedged between the rod and the cylinder to prevent the rod from being drawn in to the cylinder.

While different ways of temporarily keeping a door having a pneumatic piston and rod mechanism open have been contemplated and made available, few systems have focused on keeping a door with a pneumatic piston and rod closed for emergency purposes.

Recent tragic events such as those at Sandy Hook Elementary School in Connecticut, Columbine High School, and other locations, have prompted discussions on ways to improve security in schools and in other venues. In some instances, due to fire code regulations, and the like, the use of door locks may be disallowed. Still, even door locks may be vulnerable to forced entry because typical door locks are easily kicked-in or pushed open by blunt and sudden force.

Therefore, there is still a need for a system and method that overcomes the shortcomings of the above-mentioned prior art. The system and method described herein provides such a system and method by preventing opening of a door with a pneumatic piston and rod mechanism.

SUMMARY OF THE INVENTION

According to a preferred embodiment, an apparatus for holding a door closed, comprising: a top panel; a left wall; a right wall; a flap attached to the left wall opposite the top panel and folded under the apparatus; a flap attached to the right wall opposite the top panel and folded under the apparatus; a front end; a back end; and an opening at the front end that has a larger cross section than a cross section of the back end thereby providing for a tapered shape of the apparatus overall, such that the apparatus is configured to fit over two hinged arms of a door closing system, preventing the arms from articulating open to prevent the door from opening.

According to another preferred embodiment, a door collar lock, comprising: a top panel; a left wall; a right wall; a front end; a back end; a flap attached to the left wall opposite the top panel and folded under the apparatus; a flap attached to the right wall opposite the top panel and folded under the apparatus; and an opening at the front end that has a larger cross section than a cross section of the back end thereby providing for a tapered shape of the door collar lock overall, such that the door collar lock is configured to fit over two hinged arms of a door closing system, preventing the arms from articulating open to prevent the door from opening.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Figure 1:
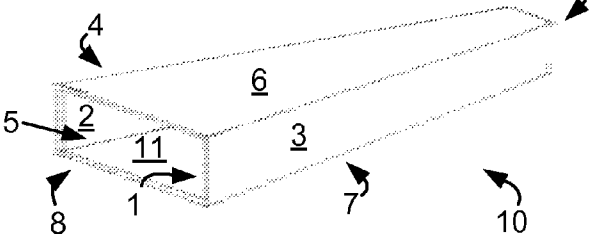
FIG. 1 is a right front perspective view of a door collar lock according to one embodiment.

Broadly, embodiments of the present invention generally provide a door collar lock that can be easily installed over the rods of a pneumatic door mechanism to prevent entry. With reference to FIG. 1, a right front perspective view of a door collar lock 10 is shown according to one embodiment. In one embodiment, the door collar lock 10 may comprise a front end 8, a back end 9, a left wall 4 (having an inner wall 2), and a right wall 3 (having an inner wall 1). The front end 8 may comprise an opening 5, which may have a planar area that may be smaller than the cross section of the front end 9, providing for a tapered shape of the door collar lock 10 overall.

The relative triangular shapes of a top panel 6 of the door collar lock 10, and a bottom panel 7 illustrate the tapering from back to front of the door collar lock 10, as also illustrated in the partial view of the inner wall 11 of the bottom panel 7.

Figure 2:
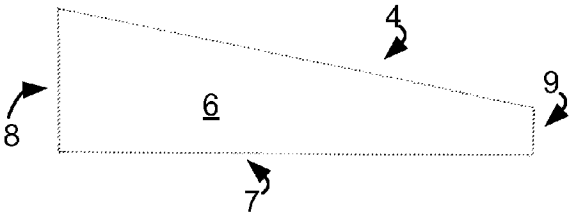
FIG. 2 is a top elevational view of the embodiment of FIG. 1.

With reference to FIG. 2, a top elevational view of the door collar lock 10 of FIG. 1 is shown. The tapered shape of the door collar lock 10 is illustrated in FIG. 2, more specifically as illustrated by the shape of the top panel 6.

Figure 3:
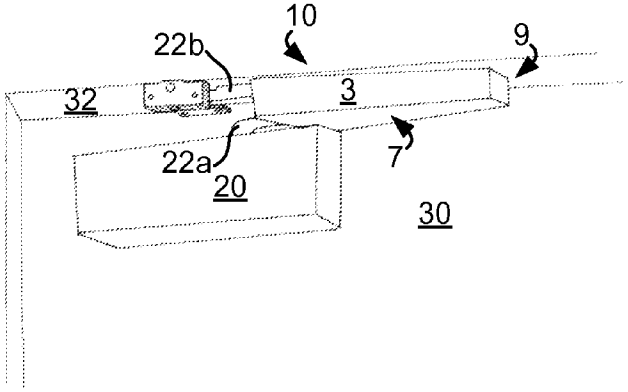
FIG. 3 is a left perspective view of a door with a pneumatic or spring actuated arm and rod configuration, with the door collar lock installed to prevent the door from opening according to the embodiment of FIG. 1.

With reference to FIG. 3, a left perspective view of a door 30 with a pneumatic or spring actuated arm and rod configuration is shown, with the door collar lock 10 installed to prevent the door 30 from opening according to the embodiment of FIG. 1. The rod or elbow 22*a* and 22*b* may consist of two articulating elongated members 22*a* and 22*b* over which the door collar 10 may be fitted by insertion over the elongated members 22*a* and 22*b*. Normally, the two elongated members 22*a* and 22*b* are free to articulate as allowed or caused by the pneumatic, hydraulic, or spring piston 20. While the piston 20 may bias the elongated members 22*a* and 22*b* to push the door 30 into the closed position with respect to the door frame 32, such a bias toward closing does not function as a lock. A person of average or low strength may still push the door open with little or no effort, as designed. However, in an emergency situation, it may be desirable to push the door collar lock 10 over the arms 22*a* and 22*b*.

Figure 4:
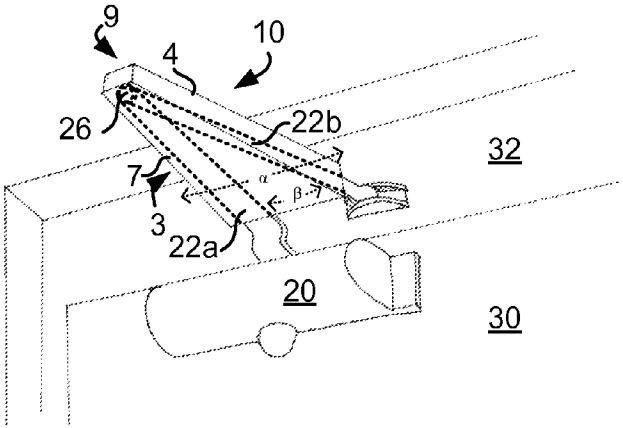
FIG. 4 is a bottom right perspective view of the door collar lock according to the embodiment of FIG. 1 installed to prevent the rods from scissoring outwardly to a more oblique angle so as to prevent opening of the door.

With reference to FIG. 4, a bottom right perspective view of the door collar lock 10 installed to prevent the rods 22*a* and 22*b* from scissoring outwardly to a more oblique angle $\alpha$ so as to prevent opening of the door 30 is shown. The rods 22*a* and 22*b* are shown in phantom for the portion covered by the door collar lock 10, and the hinge 26 between the rods 22*a* and 22*b* is further illustrated in phantom. The door collar lock 10 functions to keep the rods 22*a* and 22*b* at a relatively more acute angle $\beta$ rather than when the door 30 is in the open position with respect to the frame 32. In one embodiment, the angle $\beta$ comprises an angle by which the door 30 is substantially in a closed position with respect to the door frame 32, so as to prevent entry by a potential wrong doer in an emergency. In one embodiment, the angle $\alpha$ comprises a wider angle than angle $\beta$, so as to prevent or deter a wrong doer from entry in an emergency.

As shown in FIG. 4, the elongated design of the sides 3 and 4 of the door collar lock 10 functions to provide a distributed pressure along some or most of the length of the rods 22*a* and 22*b* when there is attempt to force the door 30 open. Having this elongated length and pressure along the rods 22*a* and 22*b*, as opposed to just one small portion of the rods 22*a* and 22*b*, makes for a more rigid stoppage of the door 30 from opening. The larger area of distribution of the pressure along the sides 3 and 4, and the planar surface areas of the top (6 in FIGS. 1 and 2) and bottom 7 of the door collar lock 10 further provides more rigidity.

Put another way, the left wall 3 and the wall 4 are configured at an angle with respect to each other so as to contact a relative substantial part of side surface areas of the arms 22*a* and 22*b* for increased distribution of force placed by the arms on the apparatus 10 as opening force is placed on the door 30. In this respect, the top 6 and bottom 7 comprise solid substantially triangular plates so as to further distribute the force placed on the apparatus 10 by the arms 22*a* and 22*b* as opening force is placed on the door 30.

FIGS. 5-9 illustrate various embodiments that provide for various storage solutions for the door collar lock 10. Storage at or in the general area of the door collar lock 10 may prevent, for example, a teacher in a classroom, or manager in an office, from having to search for the door collar lock 10 in an extreme panic during an emergency. For example, with specific reference to FIG. 5, an alternative embodiment of the door collar lock 10 includes wheels 50 on small carriages configured to roll along a mount on the door frame 32, on the side of one of the rods 22*a* and 22*b*, or on one of the rods 22*a* itself. The door collar lock 10 can then be stored to the side of the rods 22*a* and 22*b* when not in use, but then rolled into position when the door 30 is closed, over both of the rods 22*a* and 22*b*, during an emergency when in use, as shown in position in FIG. 5.

Figure 6:
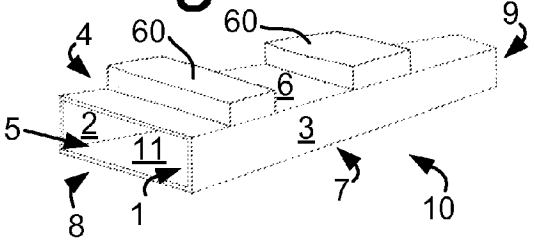
FIG. 6 illustrates yet another alternative embodiment of the door collar lock with one or more magnets attached to the top as a mounting mechanism.
Figure 5:
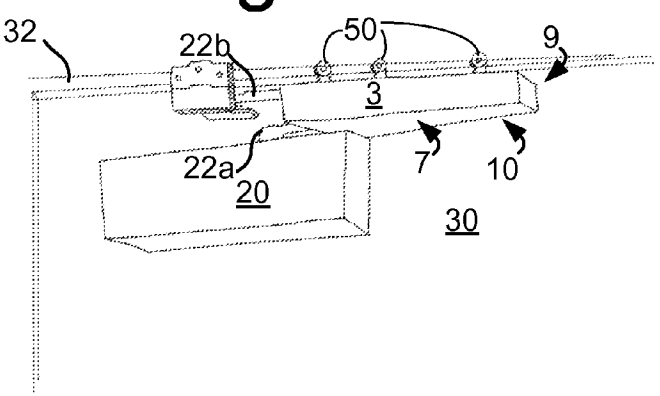
FIG. 5 illustrates an alternative embodiment of the door collar lock that includes wheels on small carriages configured to roll along a mount on the door frame, on the side of one of the rods and or on one of the rods itself.

With reference to FIG. 6, yet another alternative embodiment of the door collar lock 10 is shown with one or more magnets 60 attached to the top 6 as a mounting mechanism. In this embodiment, the door collar lock 10 may be magnetically attached to a steal structure, such as the door 30 or door frame 32 when not in use, but remain easily accessible during an emergency.

Figure 7:
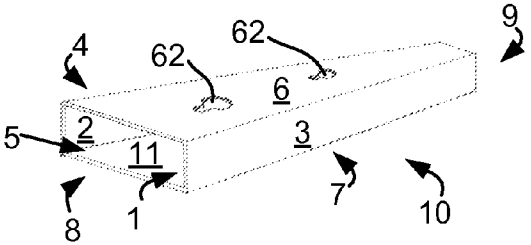
FIG. 7 illustrates yet another alternative embodiment of the door collar lock with one or more wall mounting holes located in the top.

With reference to FIG. 7, yet another alternative embodiment of the door collar lock 10 is shown with one or more wall mounting holes 70 located in the top 6 as a mounting mechanism. As with the magnets 60 in FIG. 6, the wall mounting holes 70 allow the door collar lock 10 to be position mounted in proximity to the door 30 by means of one or more nails or mounting brackets in the door 30 or wall near the door.

Figure 8:
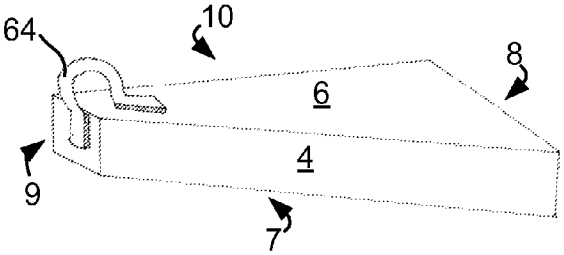
FIG. 8 illustrates yet another alternative embodiment of the door collar lock with a mounting.

With reference to FIG. 8, yet another alternative embodiment of the door collar lock 10 is shown with a mounting hook 64 located in the top 6 as a mounting mechanism. The wall-mounting hook 64 allows the door collar lock 10 to be position mounted in proximity to the door 30 by means of a nail or mounting bracket in the door 30 or wall near the door.

Figure 9:
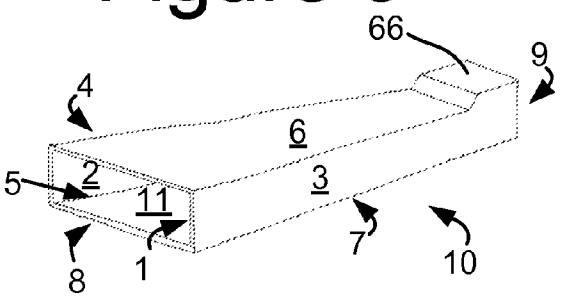
FIG. 9 illustrates yet another alternative embodiment of the door collar lock is shown with a knob to allow for more clearance for a hinge.

With reference to FIG. 9, yet another alternative embodiment of the door collar lock 10 is shown with a knob 66 to allow for more clearance for the hinge 26 within the device 10 when mounted on the elbows or arms 22*a* and 22*b*.

Figure 10:
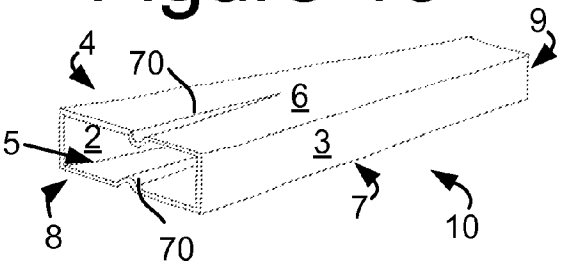
FIG. 10 illustrates yet another alternative embodiment of the door collar lock with a bevel that may allow the device to be more easily tightened around smaller.

With reference to FIG. 10, yet another alternative embodiment of the door collar lock 10 is shown with a bevel 70 that may allow the device 10 to be more easily tightened around smaller sized arms 22*a* and 22*b*.

Figure 11:
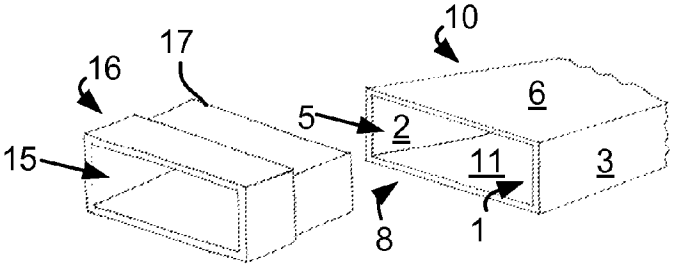
FIG. 11 illustrates yet another alternative embodiment of the door collar lock with an extension or insert having a ridge configured to slide into the opening of the device to extend the length of the device for adjustment for shorter or longer arms.

With reference to FIG. 11, yet another alternative embodiment of the door collar lock 10 is shown with an extension or insert 16 having a ridge configured to slide into the opening 5 of the device 10 to extend the length of the device 10 for adjustment for shorter or longer arms 22*a* and 22*b*. After the extension 16 is inserted into the opening 5, the arms 22*a* and 22*b* are fit through the extension's opening 15.

Figure 12:
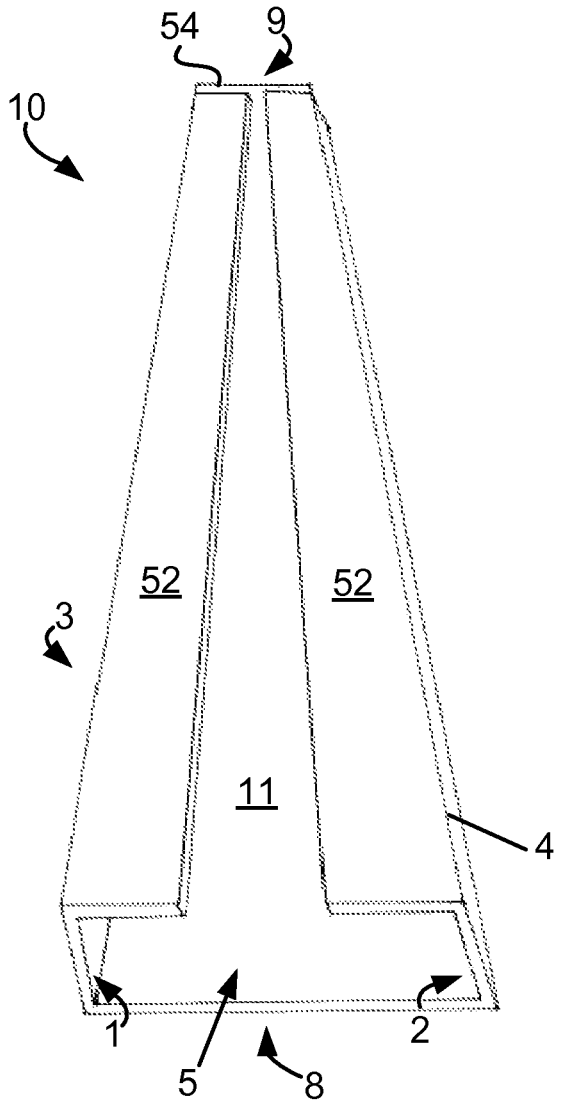
FIG. 12 is a bottom, front perspective view of an alternative embodiment of the door collar lock.

With reference to FIG. 12, a bottom, front perspective view of an alternative embodiment of the door collar lock 10 is shown. The embodiment of FIG. 12 may comprise an embodiment that eliminates any need for welding of the door collar lock 10. Instead of a having a solid bottom panel 7 as in the embodiments of FIGS. 1-11, the embodiment of FIG. 12 has a portion of the bottom panel cut out, with instead, two flaps 50 that extend from the sides 3 and 4 of the lock 10, bent into the bottom of the lock 10.

Figure 13:
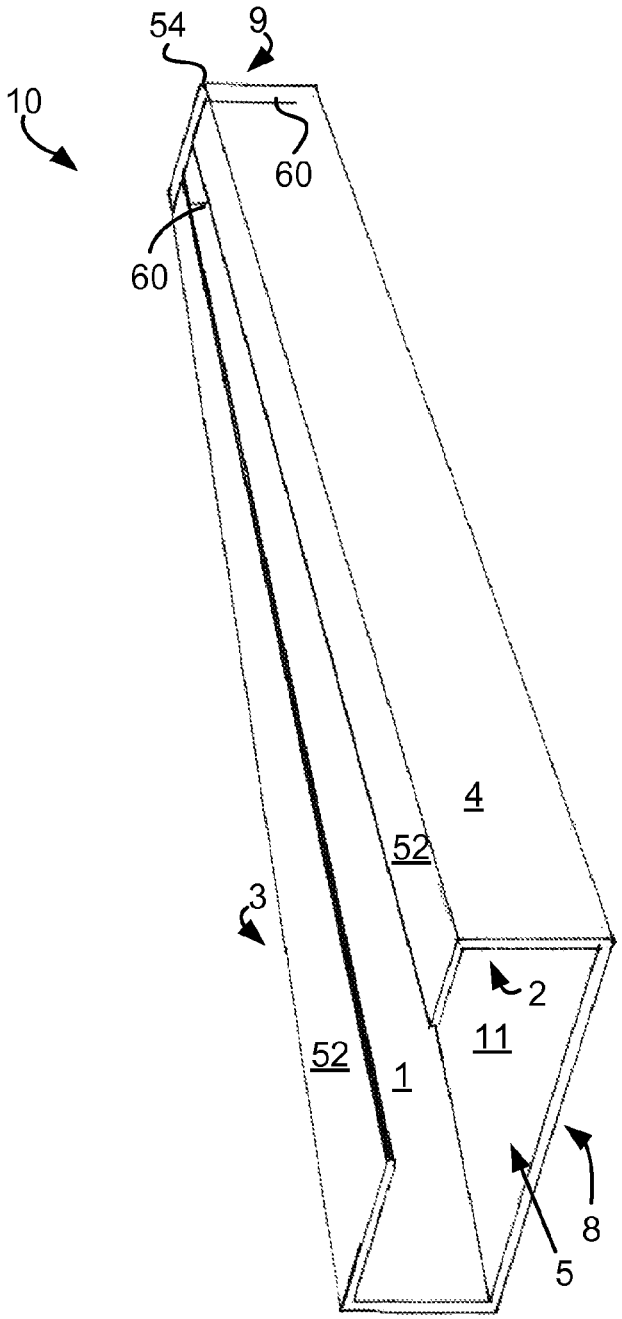
FIG. 13 is a bottom left perspective view of the embodiment of FIG. 12.

With reference to FIG. 13, a bottom left perspective view of the embodiment of FIG. 12 is shown. The top 9 of the door collar lock 10 may comprise an end cap 52 that is extended from the bottom panel 7, and which may not be directly connected to the sides 3 and 4 of the lock 10 for ease of manufacturing, which may result in slits 60 down the sides of the end cap 54 between the sides 3 and 4 and the end cap 54. Optionally, the end cap 54 may be attached, welded, or glued to the sides 3 and 4 after shaping of the lock 10 during manufacturing.

The embodiment of FIGS. 12 and 13 may allow the door collar lock 10 to be made by brake-pressing it. The whole pattern can be laid flat (from one geometric shape) and cut by a laser. Next, a brake machine may make five brakes to fold the finished brake press lock 10. There may be, for example, one brake for the end cap 54, and another brake for each side 3 and 4, and another two breaks to fold the flaps 52 that form the open channel on the bottom. This embodiment may cut down significantly on costs of manufacturing, without compromising strength. In this respect, in one embodiment, it may be advantageous to use a gauge of steel of sufficient thickness for the rigidity to cause toe creases or brakes in the lock 10 to remain substantially permanent during use to hold when the lock 10 is put under duress.

Figure 14:
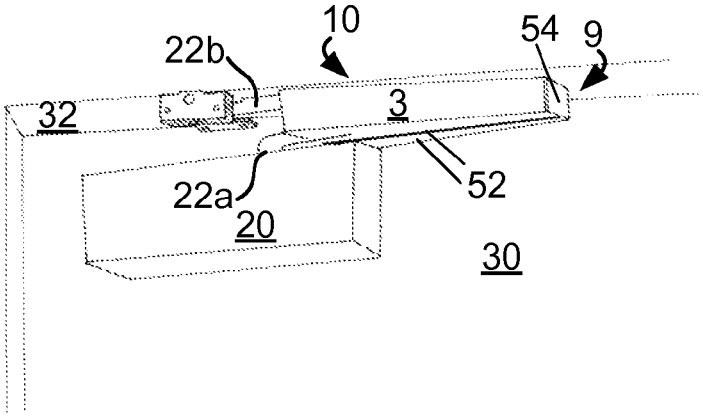
FIG. 14 is a left perspective view of a door with a pneumatic or spring actuated arm and rod configuration, with the embodiment of FIGS. 12 and 13 installed to prevent the door from opening.

With reference to FIG. 14, a left perspective view of a door with a pneumatic or spring actuated arm and rod configuration, with the embodiment of FIGS. 12 and 13 installed to prevent the door from opening is shown. As shown in FIG. 14, even in the absence of a solid bottom 7 as with the embodiment of FIG. 3, the flaps 52 still provide enough force over the arms 22*a* and 22*b* to prevent a person from pushing the door open when the embodiment of FIG. 14 is installed over the arms 22*a* and 22*b*, functioning in the same way as the embodiment of FIG. 3.

It should be understood, of course, that the foregoing relates to exemplary embodiments of the invention and that modifications may be made without departing from the spirit and scope of the invention as set forth in the following claims.

The invention claimed is:

1. An apparatus for use with a door movably attached to a frame via a pair of hingedly connected articulating arm members, where said apparatus is adapted to slide over said arm members when said door is closed and prevent the door from being opened, said apparatus, comprising:

a top panel, said top panel having a generally triangular shape, said top panel further comprising a left side, said left side having a length, a right side, said right side having a length that is equal to the length of said left side, a front side, said front side having a width, and a back side, said back side having a width that is less than the width of the front side;

a left wall, said left wall attached to said top panel, said left wall extending perpendicularly from said left side of said top panel;

a right wall, said right wall attached to said top panel, said right wall extending perpendicularly from said right side of said top panel;

a left flap, said left flap attached to the left wall opposite the top panel, said left flap extending toward said right wall, said left flap disposed parallel to said top panel;

a right flap, said right flap attached to the right wall opposite the top panel, said right flap extending toward said left wall, said right flap disposed parallel to said top panel and spaced apart from said left flap;

a front opening, said front opening formed at said front end of said apparatus by said top panel, said left wall, said right wall, said left flap, and said right flap, said front opening having a cross sectional area; and a back opening, said back opening formed at said back end of said apparatus by said top panel, said left wall, said right wall, said left flap, and said right flap, said back opening having a cross sectional area that is less than the cross sectional area of said front opening thereby providing for a tapered shape of the apparatus overall and an open tapered channel between said left wall and said right wall, such that the apparatus is configured to fit over said two hingedly connected arm members and prevent said door from being opened.

2. The apparatus of claim 1, wherein the apparatus further comprises at least one wheel disposed on said top panel.

3. The apparatus of claim 1, wherein the apparatus further comprises at least one magnet disposed on said top panel.

4. The apparatus of claim 1, wherein the apparatus further comprises at least one bore disposed through said top panel.

5. An apparatus for use with a door movably attached to a frame via a pair of hingedly connected articulating arm members, where said apparatus is adapted to slide over said arm members when said door is closed and prevent the door from being opened, said apparatus, comprising:

a top panel, said top panel having a generally triangular shape, said top panel further comprising a left side, said left side having a length, a right side, said right side having a length that is equal to the length of said left side, a front side, said front side having a width, and a back side, said back side having a width that is less than the width of the front side;

a left wall, said left wall attached to said top panel, said left wall extending perpendicularly from said left side of said top panel;

a right wall, said right wall attached to said top panel, said right wall extending perpendicularly from said right side of said top panel;

a bottom panel, said bottom panel attached to said left wall and said right wall, said bottom panel disposed opposite and parallel to said top panel;

a front opening, said front opening formed at said front end of said apparatus by said top panel, said left wall, said right wall, and said bottom panel, said front opening having a cross sectional area; and a back opening, said back opening formed at said back end of said apparatus by said top panel, said left wall, said right wall, and said bottom panel, said back opening having a cross sectional area that is less than the cross sectional area of said front opening thereby providing for a tapered shape of the apparatus overall and an open tapered channel between said left wall and said right wall, such that the apparatus is configured to fit over said two hingedly connected arm members and prevent said door from being opened.

6. The apparatus of claim 5, wherein the apparatus further comprises at least one wheel disposed on said top panel.

7. The apparatus of claim 5, wherein the apparatus further comprises at least one magnet disposed on said top panel.

8. The apparatus of claim 5, wherein the apparatus further comprises at least one bore disposed through said top panel.

* * * * *